US005730851A

United States Patent [19]

Arrowsmith et al.

[11] Patent Number: 5,730,851

[45] Date of Patent: Mar. 24, 1998

[54] METHOD OF MAKING ELECTRONIC HOUSINGS MORE RELIABLE BY PREVENTING FORMATION OF METALLIC WHISKERS ON THE SHEETS USED TO FABRICATE THEM

[75] Inventors: Peter Arrowsmith, North York, Canada; Peter Beverley Powell Phipps, Saratoga, Calif.

[73] Assignee: International Business Machines Corporation, Armonk, N.Y.

[21] Appl. No.: 596,049

[22] Filed: Feb. 6, 1996

[30] Foreign Application Priority Data

Feb. 24, 1995 [CA] Canada ..... 2143606

[51] Int. Cl.[6] ..... C25D 7/06; C25D 5/10

[52] U.S. Cl. ..... 205/155; 205/177; 205/182

[58] Field of Search ..... 205/170, 177, 205/181, 182, 192, 293, 155

[56] References Cited

U.S. PATENT DOCUMENTS

| | | | |
|---|---|---|---|
| 9,270 | 9/1852 | Bucklin | 427/310 |
| 1,615,585 | 1/1927 | Humphries | 205/177 |
| 2,002,261 | 5/1935 | Domm | 18/53 |
| 2,039,069 | 4/1936 | Domm | 91/68.2 |
| 2,115,749 | 5/1938 | Rubin | 204/8 |
| 2,323,890 | 7/1943 | Adler | 204/35 |
| 2,392,456 | 1/1946 | Brown et al. | 204/37 |
| 2,870,526 | 1/1959 | Adler | 29/183.5 |
| 3,716,462 | 2/1973 | Jensen | 204/38 B |
| 3,869,261 | 3/1975 | Katsuma | 291/196.3 |
| 3,954,420 | 5/1976 | Hyner et al. | 29/183.5 |
| 4,480,166 | 10/1984 | Leech | 219/118 |
| 4,828,000 | 5/1989 | Lievens et al. | 152/451 |

FOREIGN PATENT DOCUMENTS

| | | |
|---|---|---|
| 49-076736 | 7/1974 | Japan . |
| 49076736 | 7/1974 | Japan . |
| 55-54589 | 4/1980 | Japan . |
| 817144 | 7/1959 | United Kingdom . |

*Primary Examiner*—Kathryn L. Gorgos
*Assistant Examiner*—Edna Wong
*Attorney, Agent, or Firm*—Richard M. Goldman

[57] ABSTRACT

A metallic sheet for an electronic housing having a zinc coating on a steel base and a thin metal film, preferably a copper film, covering the zinc coating on one or both sides of the sheet, and a method of making the metal film. The metal film reduces whiskering of the zinc in the zinc coating. Whiskering can also be prevented on other metals anodic to copper such as, for example, tin and cadmium.

1 Claim, No Drawings

METHOD OF MAKING ELECTRONIC HOUSINGS MORE RELIABLE BY PREVENTING FORMATION OF METALLIC WHISKERS ON THE SHEETS USED TO FABRICATE THEM

THE PURPOSE OF THE INVENTION

The present invention provides an improved process for making material for electronic housing assemblies and improved material for such housings. The improved material reduces conductive contamination within the housing.

INTRODUCTION

Electroplated pure zinc (EPZ) coatings are commonly used for corrosion protection of sheet steel. Sheet steel is widely used for housing electronic assemblies. In the prior art, a thin (usually clear or yellow) chromate conversion coating is applied over the EPZ coating to prevent corrosion of the zinc and improve the appearance of the surface. Under some conditions the EPZ coatings may produce microscopic filamentary zinc whiskers of a diameter typically between 1–2 micron. These whiskers grow out of the plated surface and may attain lengths of several mm. These zinc whiskers are readily broken off and carried by cooling air flows into electronic assemblies, both within and external to the housing, where they may cause short-circuit failure.

The tendency of the EPZ coatings to whisker is affected by the amount of stress in the film and other factors. One other factor is the concentration of organic brightener in the plating bath. The chromate conversion coating offers little or no protection against whiskering. The whiskers easily push their way through the conversion layers.

The thickness of the chromate conversion coating is typically 250 to 500 Angstrom. The normal or typical chromate process cannot be used to make a thicker chromate coating since the underlying zinc tends to dissolve if the parts are simply left in the bath. A chromate coating also increases the electrical resistance of the surface of the housing such that too thick a coating results in poor grounding and degradation of shielding properties.

We have discovered that, unlike the chromate conversion coating, a thin film of copper will prevent or substantially reduce whisker growth. It should be noted, of course, that the present invention also applies to other protective coatings where whiskering can occur. For example, whiskering can be prevented on other metals anodic to copper such as tin and cadmium. However, in describing the invention, the disclosure will concentrate on zinc coatings which are more commonly employed in the protection of steel electronic housing assemblies.

BACKGROUND

The application of a copper coating over a zinc coating is well known in the art. U.S. Pat. No. 9,270 to Bucklin describes a process for putting a copper coating on galvanized iron for decorative purposes. U.S. Pat. No. 2,002,261 describes a process for depositing copper on a zinc coating on a wire to improve adhesion of rubber to the wire. U.S. Pat. Nos. 2,039,069 to Domm, 2,154,834 to Lamater, 2,323,890 and 2,870,526 to Adler and 4,828,000 to Lieyens et al, all describe improvements in the process for adhering rubber to a wire using layers of zinc and copper.

U.S. Pat. No. 3,716,462 describes an electroless plating process for forming a copper layer over a zinc die casting. The patent further describes a process in which additional layers of nickel and chrome are formed over the copper to provide a coating having improved corrosion resistance and being bright and attractive. The invention is not concerned with the formation of troublesome zinc whiskers. U.S. Pat. Nos. 3,869,261 to Katsuma and 3,954,420 to Hyner et al, also describe coatings of zinc and copper on steel that are highly corrosion resistant. However, both patents subject the coatings to heat to form an alloy. This step is unnecessary to prevent the formation of zinc whiskers as taught by the present invention.

None of the art discloses that such coatings are an economical and reliable method for protecting electronic assembly housings from harmful effects of the formation of zinc whiskers.

STATEMENT OF INVENTION

Our invention provides a thin film of copper on an EPZ coating. The copper provides low surface electrical resistance and intrinsic protection against whisker growth.

This improves the EMI/RFI performance and electrical grounding characteristics.

The copper may be applied either electrolessly or electrolytically following deposition of EPZ. The copper film can be thin, (of the order of 500 to 25,000 Angstroms).

The short process time required and the low cost of copper plating solutions makes this process economically attractive.

The present invention provides a metallic sheet for an electronic assembly housing. The sheet comprises a steel plate having a first coating of zinc thereon and a second coating of copper covering the first coating.

The present invention also provides a method of forming a metallic sheet for an electronic assembly housing. The method includes the steps of electroplating the metallic sheet with a first coating of zinc; and depositing a layer of a metal selected from nickel, gold, rhodium or copper on the zinc coating.

DESCRIPTION OF THE INVENTION

Chromate conversion coatings are widely used to protect any type of plated zinc coating including zinc alloys from corrosion. However, these coatings require special treatment such as thermal annealing or the formation of alloy plating layers to prevent the formation of zinc whiskers. These added steps or more complex processes are not required if a copper film is used to replace the chromate conversion coating. The whiskering of the zinc coating has been substantially reduced in the prior art by alloying zinc with another metal such as nickel, cobalt or iron. However, this alloying process is expensive. Simply coating an EPZ coating with a copper layer is a much cheaper alternative.

Thermal annealing of the steel after plating with an EPZ coating has also been used to reduce stress in the plated film and thereby reduce whisker formation. Again this adds an expensive processing step that is unnecessary when a thin film of copper is put on the EPZ layer.

Electroplated pure zinc coatings on steel enclosures have a tendency to grow whiskers. If the appropriate surfaces of the zinc are coated with a thin layer of a base metal such as copper this tendency is substantially reduced or eliminated. A preferred process using copper electrode position involves the steps of cleaning the zinc coating and depositing the copper on the cleaned coating.

Grease and microscopic dirt are removed from the zinc coating with organic solvents, or with aqueous surfactants. The zinc plated surface is agitated, for 1–2 minutes, in a solution of 25g/l of tri-sodium orthophosphate, $Na_3PO_4.12H_2O$, plus 1 g/l of sodium dodecyl benzene sulfonate, at a temperature of 80 degrees Celsius. The zinc coated surface is then washed in water and neutralized with a 2.5 g/l sulfuric acid solution for 15 seconds. The cleaned surface is then rinsed thoroughly and is now ready for deposition of the copper.

A preferred deposition bath has the following composition:

| Component | Preferred value | Range | Units |
|---|---|---|---|
| CuCN | 25 | 20–45 | g/l |
| NaCN | 35 | 25–55 | g/l |
| $Na_2CO_3$ | 30 | 15–60 | g/l |
| Rochelle salt | 50 | 30–60 | g/l |

Rochelle salt is the tetra hydrate of sodium potassium tartrate, $NaKC_4H_4O_6.4H_2O$.

The bath is maintained at a temperature between 55 and 70 degrees Celsius and, preferably, at a temperature of 62 degrees Celsius. The pH of the bath is kept between 10.2 and 11.5 and, preferably at 10.3. The current density at the cathode, (i.e. the zinc-coated part), is maintained between 1.6 and 6.5 amperes per square decimeter and, preferably, at 3 Amps/sq dm.

The anode should be pure copper with twice the area of the cathode. The solution should be stirred by continuous filtration, and the part being coated should be agitated in the solution while deposition takes place, typically from 1–3 minutes. The part should be connected to a power supply before immersion.

It will be obvious to those skilled in the art that many variations in this process will also provide thin, uniform, adherent coats of copper without attacking the underlying zinc. For example, copper can be deposited from a pyrophosphate bath instead of the above-described cyanide bath. Brass can be deposited in place of copper or other base metals such as Nickel can be deposited over a thin copper strike. Brush plating can be used. Furthermore, similar processes can be used to protect cadmium or tin coatings from shedding whiskers.

The optimum process should have good coverage of the relevant surfaces. It is not necessary for the film to be pore free. The thickness of the plated metal, preferably copper, could be from 0.05 to 2.5 micrometers.

If whisker growth occurs, the whisker will mechanically push through an upper thin film, regardless of whether chromate conversion or copper plating is used. However, copper and zinc form a galvanic pair and exposure of the zinc-copper interface to a humid atmosphere will cause the zinc to sacrificially oxidize. The copper cathode will tend to be cathodically protected by this current. Due to their small cross section, zinc whiskers will corrode rapidly when these structures are exposed to room conditions. Any protruding whisker will be converted into zinc oxide, hydroxide and carbonate, all of which are electrically nonconducting and harmless. Hence, unlike with chromate conversion, a copper thin film prevents whisker growth or, if growth does occur, permits the zinc whiskers to convert to electrically nonconducting compounds which are harmless in the housing assembly environment.

It is apparent to those familiar with corrosion chemistry that other metals which are cathodic relative to zinc could be used in place of copper. For example, nickel, gold or rhodium are all good candidates. These layers are relatively inexpensive since they are needed in only very thin films.

Whiskers may be removed from zinc, or other metals prone to whiskering, such as tin or cadmium, using other variations, which are within the scope of the present invention. For example, a thin layer of copper could be deposited by simply immersing the plated parts in a copper solution. In some cases, a conductive paint containing base metal particles may be more conveniently used to put a coating on the zinc coating.

We claim:

1. A method of forming a metallic sheet for an electronic assembly housing having the steps of;

electroplating said metallic sheet with a coating consisting essentially of zinc; and thereafter immersing said sheet in an electroplating bath, said bath containing between 20 and 45 grams per liter of CuCN, between 25 and 55 grams per liter of NaCN, between 15 and 60 grams per liter of $Na_2CO_3$ and between 30 and 60 grams per liter of $NaKC_4H_4O_6.4H_2O$ at a temperature between 55 and 70 degrees Celsius and at a pH between 10.2 and 11.5, and electrodepositing a layer of copper over the zinc coating, where any subsequently formed zinc whiskers corrode rapidly.

* * * * *